US011280118B2

(12) United States Patent
Davis et al.

(10) Patent No.: US 11,280,118 B2
(45) Date of Patent: Mar. 22, 2022

(54) VEHICLE DOOR LOCK WITH GEAR THRUST RETAINER

(71) Applicant: Kiekert AG, Heiligenhaus (DE)

(72) Inventors: Scott Davis, Clinton Township, MI (US); Robert S. Pettengill, Farmington, MI (US)

(73) Assignee: Kiekert AG, Heiligenhaus (DE)

( * ) Notice: Subject to any disclaimer, the term of this patent is extended or adjusted under 35 U.S.C. 154(b) by 471 days.

(21) Appl. No.: 15/846,649

(22) Filed: Dec. 19, 2017

(65) Prior Publication Data

US 2018/0171682 A1 Jun. 21, 2018

Related U.S. Application Data

(60) Provisional application No. 62/436,113, filed on Dec. 19, 2016.

(51) Int. Cl.
*E05B 81/40* (2014.01)
*E05B 81/34* (2014.01)
(Continued)

(52) U.S. Cl.
CPC ..... *E05B 81/40* (2013.01); *E05B 81/16* (2013.01); *E05B 81/06* (2013.01); *E05B 81/34* (2013.01)

(58) Field of Classification Search
CPC ..... Y10T 292/1082; Y10T 292/1078; Y10T 292/1021; Y10T 403/67; Y10T 403/68; Y10T 403/7091; E05B 81/40; E05B 81/16; E05B 81/06; E05B 81/34; E05B 81/14; E05B 81/26; E05B 81/30; F16B 7/187
See application file for complete search history.

(56) References Cited

U.S. PATENT DOCUMENTS 2,026,454 A * 12/1935 Benzing ..... F16B 21/186 411/517
2,487,803 A * 11/1949 Heimann ..... F16B 2/245 403/247
(Continued)

FOREIGN PATENT DOCUMENTS

BR 9000030-7 U2 1/2012
DE 9303362 U1 * 4/1993 ..... H02K 7/081
(Continued)

OTHER PUBLICATIONS

Computer Generated Translation for KR 1020170125158 A, https://dialog.proquest.com/professional/cv_2183530/docview/1967887797/1704E37536C4B6A0AF3/6?accountid=131444 (Year: 2020).*
(Continued)

*Primary Examiner* — Alyson M Merlino
(74) *Attorney, Agent, or Firm* — Renner, Otto, Boisselle & Sklar, LLP

(57) ABSTRACT

A vehicle lock for a door or a flap of a motor vehicle, the vehicle lock including a locking mechanism with a catch and a pawl for latching the catch as well as a gear mechanism with a spindle for moving a nut and for transferring a motion and/or force to the locking mechanism by the nut movement for locking or unlocking the vehicle lock, and a clip for holding the spindle in an axial position. A simple and easy to produce vehicle lock with reduced number of parts, in particular without thrust plates, can be obtained.

17 Claims, 3 Drawing Sheets

(51) Int. Cl.
*E05B 81/16* (2014.01)
*E05B 81/06* (2014.01)

(56) References Cited

U.S. PATENT DOCUMENTS 3,726,575 A * 4/1973 Moorman ..... F16B 21/16 310/90
4,197,054 A * 4/1980 Morrill ..... F04D 29/34 416/135
4,381,656 A * 5/1983 Hayakawa ..... E05B 9/084 292/DIG. 53
4,932,277 A * 6/1990 Beaux ..... E05B 81/25 292/201
4,932,690 A * 6/1990 Kleefeldt ..... E05B 81/06 292/201
4,969,672 A * 11/1990 Childs ..... E05B 81/14 292/201
4,974,886 A * 12/1990 Kleefeldt ..... E05B 81/06 292/201
4,978,154 A * 12/1990 Kleefeldt ..... E05B 81/06 292/201
5,000,614 A * 3/1991 Walker ..... F16L 37/088 285/305
5,025,682 A * 6/1991 McCabe ..... F16B 21/186 74/606 R
5,056,343 A * 10/1991 Kleefeldt ..... E05B 81/25 292/DIG. 23
5,419,597 A * 5/1995 Brackmann ..... E05B 81/06 292/201
5,441,315 A * 8/1995 Kleefeldt ..... E05B 81/25 292/201
5,462,369 A * 10/1995 Layne ..... F16C 35/063 384/538
5,722,272 A * 3/1998 Bridgeman ..... E05B 81/16 70/264
5,983,739 A * 11/1999 Feder ..... E05B 81/25 70/280
6,308,587 B1 * 10/2001 Shinkawa ..... E05B 81/25 185/40 B
6,748,816 B2 * 6/2004 Rogers, Jr. ..... F16H 25/20 185/40 R
6,983,958 B2 * 1/2006 Rautureau ..... F16L 37/144 285/305
6,997,488 B2 * 2/2006 Kurten ..... E05B 81/14 292/201
7,475,920 B2 * 1/2009 Bigazzi ..... E05B 81/14 292/201
7,699,356 B2 * 4/2010 Bucher ..... F16L 37/0885 285/321
8,590,946 B2 * 11/2013 Gumbo ..... E05B 81/14 292/201
2008/0224482 A1 * 9/2008 Gumbo ..... E05B 81/14 292/216
2010/0232874 A1 * 9/2010 Bjoerck ..... F16D 1/10 403/359.1
2015/0338001 A1 * 11/2015 Bush ..... F16L 37/144 285/179
2016/0177602 A1 6/2016 Graute et al.
2016/0214507 A1 7/2016 Heeg et al.
2016/0244998 A1 * 8/2016 Kraus ..... E05B 81/34
2018/0372149 A1 * 12/2018 Tajima ..... F16H 25/20

FOREIGN PATENT DOCUMENTS

DE 10242570 A1 * 3/2004 ..... H02K 7/081
DE 10 2013 224 248 B3 3/2015
DE 20 2014 106 158 U1 3/2016
GB 1228044 A * 4/1971 ..... F16B 21/16
KR 1020170125158 A * 11/2017

OTHER PUBLICATIONS

Maryland Metrics: Retaining Rings, Circlips, and Shims, https://mdmetric.com/retring.htm (Year: 2014).*
Computer Generated Translation for DE9303362, generated on Sep. 11, 2020, https://worldwide.espacenet.com/ (Year: 2020).*

* cited by examiner

VEHICLE DOOR LOCK WITH GEAR THRUST RETAINER

This application claims priority to U.S. Provisional Patent Application No. 62/436,113 filed Dec. 19, 2016, which is hereby incorporated herein by reference in its entirety.

The invention concerns a vehicle lock for a door or a flap of a motor vehicle comprising a locking mechanism with a catch and a pawl for latching the catch as well as a gear mechanism with a spindle for moving a nut and for transferring a motion and/or force to the locking mechanism by the nut movement for locking or unlocking the vehicle lock.

BACKGROUND

Nowadays, motor vehicles provide a high degree of automation for different functions to the car driver. Vehicle door locks are usually lockable and unlockable in an automatic manner e.g. by means of an electric motor. When the door is closed, a locking bolt of the door is received by the catch, which is turned by the motion of the locking bolt into a locking position, in which the catch is latched by the pawl. To unlock the vehicle lock, a release lever is activated or turned to move the pawl such that the pawl releases the catch. The catch can thus return to an open position and the locking bolt can leave the vehicle lock while the door is opened. During automated unlocking, the force and motion to activate the release lever can be provided by the electric motor and transferred to the release lever by means of the gear mechanism.

Presently used gear mechanism for such vehicle lock for a door or flap often work with a rotatable spindle for moving a nut in an axial direction to activate the release lever. The resulting axial forces that act on the spindle, which should remain at its axial position all the time during operations, are commonly retained by thrust plates on either side of the spindle. These thrust plates are connected to the housing of the gear mechanism or are part of a second housing part that is connected to a first housing part to facilitate assembly and appropriate protection of the gear mechanism. A spring element may be utilized between one of the thrust plates and a component mounted on the spindle for ease of operations.

However, the manufacturing and assembly of such a vehicle lock is made difficult and expensive due to the high number of parts and the plenty of resulting and narrow manufacturing and assembly tolerances to be matched. In many cases, overmolding the gear to the spindle becomes necessary that further increases the manufacturing expenditures.

The document BRMU9000030U2 discloses another vehicle lock for a door having a gear mechanism comprising a spindle but with a different functionality. The documents DE102013224248B3 and DE202014106158U1 show different gear mechanisms with a spindle, but not for use in a vehicle lock for a door or a flap of a motor vehicle, where a motion and force to the locking mechanism is transferred by a nut movement for locking or unlocking the vehicle lock.

The content of the cited documents is incorporated by reference herein.

SUMMARY

The invention provides a further developed vehicle lock for a door or a flap of a motor vehicle having a gear mechanism with a spindle for moving a nut and for transferring a motion and/or force to the locking mechanism by the nut movement for locking or unlocking the vehicle lock. More particularly, one or more problems are solved by a vehicle lock for a door or a flap of a motor vehicle according to the main claim. Preferred embodiments are described in the dependent claims.

The above described features known from the prior art can be combined alone or in combination with the below disclosed features of the present invention and one of the below described embodiments of the invention.

In accordance with the invention, a vehicle lock for a door or a flap of a motor vehicle, comprises a locking mechanism with a catch and a pawl for latching the catch as well as a gear mechanism with a spindle for moving a nut and for transferring a motion and/or force to the locking mechanism by the nut movement for locking or unlocking the vehicle lock.

The vehicle lock according to the invention comprises a clip that is composed to hold the spindle in an axial position.

A door is typically a side door of a vehicle.

A flap can be a hatch, liftgate, back door, rear flap, tailgate or trunk lid.

A gear mechanism commonly transfers a motion and/or force from an engine, particularly an electric motor, to a movable component. Motion can be rotational motion or translational motion. Force can be moment force or linear force. In particular, a gear mechanism serves to change the rotational speed and/or the nature of the motion and/or force. For example, a rotational motion is transformed into a translational motion and/or a moment force is transformed into a linear force such as a lateral or axial force.

A spindle is typically a threaded and/or longitudinal rod. Threaded means having a section with an external thread. In particular, there is only one spindle.

A nut is typically a member having an internal thread. The outer shape of the nut can be variously formed. For example, the nut can have a two arms extending from a particularly cylindrical section comprising the internal thread. In particular, the internal thread of the nut corresponds to the external thread of the spindle such that the spindle can be screwed into and/or out of the nut.

A gear mechanism with a spindle for moving a nut means a spindle with is configured and arranged to move the nut in axial direction for example forth or back by rotation of the spindle. The nut is preferably guided in axial direction in a way that the nut can conduct an axial translational movement but not a rotational movement about the spindle axis or at least not a rotation for more than 360 degree about the spindle axis. In particular, the nut is moved by the rotation of the spindle, which remains in its axial position while the nut is moved along the spindle axis.

A gear mechanism with a spindle for transferring a motion and/or force to the locking mechanism by the nut movement for unlocking the vehicle lock typically includes that the spindle moves the nut and the nut moves a release lever, preferably immediately or though an intermediate lever, wherein the release lever is composed to move the pawl out of the latching position with the catch.

A gear mechanism, i.e. gear train or gear assembly, with a spindle for transferring a motion and/or force to the locking mechanism by the nut movement for locking the vehicle lock typically includes that the spindle moves the nut and the nut cinches the catch and/or moves the catch, preferably immediately or though an intermediate lever, in order to pull or turn the catch into the latching position. For example, when the catch is latched in an ancillary latching position or unlatched in some intermediate position between the open position and the latching position of the catch, the catch can thereby be brought into the latching position.

A clip is typically a means or member to hold a part in a tight grip or to clutch. In particular, a clip or a section of a clip allows elastic deformation such that a part can be received by the clip only by means of said elastic deformation and/or only released from the clip by means of said elastic deformation. Preferably, a clip comprises an entrance which is composed to allow elastic widening to temporarily increase an entrance opening or entrance path. A part with larger dimensions than the entrance opening or entrance path can thereby pass through or enter the entrance opening or entrance path. Once having passed the entrance opening or entrance path, the entrance elastically contracts back to its original shape such that the part is captured in and/or secured by the clip.

Axial position refers to a particularly predetermined position on the spindle axis, preferably related to the housing of the gear mechanism or the engine, e.g. electric motor. The spindle axis defines the axial direction.

Clip composed to hold the spindle in an axial position means that the clip is composed and/or arranged to hold the spindle in an axial position along the spindle axis.

In particular, the clip is connected to the spindle and/or the housing by a form fit and/or positive connection. A clip is generally a one piece clip.

In particular, the clip holds the spindle in a tight grip or the clip clutches the spindle.

By providing the vehicle lock according to the invention with a clip that is composed to hold the spindle in an axial position, the need for thrust plates on either end of spindle can be eliminated, the gear mechanism can be packaged in only one single support housing that is connected to a lower housing and/or frame plate, tolerances between gears can be improved or matched with less effort, and the need for overmolding the gear to the spindle can be eliminated.

The spindle can be assembled from one side through a bearing hole at one end of the support housing, through a gear wheel, the return spring, the bushing, the nut, and into a coaxial other bearing hole at the other end of the same single piece support housing. The advantage is that there is better locational tolerance to mating gears retained in the support housing. After insertion into the housing, gear and nut, the spindle is retained by the clip. Preferably, the clip is mounted thereafter or at last to the spindle. In particular, the clip acts as a thrust bearing to retain the lateral or axial force of the spindle. This is an improvement over prior art which use thrust plates on either side of the spindle to retain the lateral force of the spindle.

When using thrust plates, there is typically only a very small interface area with the spindle when retaining lateral forces of the spindle, thus little friction. In contrast, a clip that is composed to hold the spindle in an axial position, generally has a bigger interface area with the spindle, thus more friction.

For this reason, thrust plates have been favored and clips avoided for retaining the axial, i.e. lateral, forces of the spindle, as higher friction requires higher activation energy to move the nut.

Especially when having a gear mechanism with a return spring as commonly implemented to return the nut in a park position after for example an axial nut movement to release the lock, there is permanent axial force acting on the spindle (see for example FIG. 2). Said friction can therefore require significantly higher driving power to operate the gear mechanism and thus the vehicle lock.

Furthermore, thick thrust plates are commonly used because they are regarded as very reliable and durable means to retain the spindle. Clips however with their commonly thin plate or wires thickness were also avoided to reduce the risk of failure which could be life-threatening.

The applicant overcame this prejudice by having the insight that a clip can in fact also be used for reliable retention of axial forces in a vehicle lock for a door or a flap of a motor vehicle comprising a locking mechanism with a catch and a pawl for latching the catch as well as a gear mechanism with a spindle for moving a nut and for transferring a motion and/or force to the locking mechanism by the nut movement for locking or unlocking the vehicle lock.

Moreover, the applicant had the insight that the increase of needed space for an eventually bigger dimensioned electrical motor is overcompensated by the space saving thanks to the use of a clip instead of thrust plates to retain axial forces of the spindle. Furthermore, the reduced manufacturing and assembly expense thanks to the use of a clip as thrust retainer for the spindle enables to provide a vehicle lock for a door or a flap with high reliability at reduced costs.

In one embodiment, there is only one clip provided for retaining axial forces of the spindle, particularly any or all axial forces of the spindle.

Axial forces are forces acting in parallel to the spindle axis. Any or all axial forces do not consider counteracting friction forces of for example a plain bearing of the spindle.

Axial forces of the spindle are axial forces there are transferred to the spindle and would cause an axial translational motion of the spindle when not considering counteracting friction forces of for example a plain bearing of the spindle. In other words, axial forces of the spindle are forces that are applied by the spindle in axial direction to an adjacent part.

By providing only one clip for retaining axial forces of the spindle, the number of parts can be reduced and a very compact design can be obtained. Furthermore, a better locational tolerance especially to mating gears retained in the housing can be obtained.

In one embodiment, the spindle is pivoted by means of one or exactly two through holes, preferably as plain bearings, i.e. preferably the exactly two through holes form plain bearings.

The spindle being pivoted by means of exactly two through holes means that the spindle is rotatable mounted by exactly two through holes.

In general, the spindle has a smooth surface at the interface with a through hole.

A plain bearing commonly comprises just a bearing surface such as a hole surface but no rolling elements. Therefore, the spindle typically slides over the hole or bearing surface. The simplest example of a plain bearing is a shaft rotating in a hole.

A low cost, compact and lightweight bearing with high load bearing capacity can thereby be provided.

In one embodiment, a one piece support housing for housing the gear mechanism comprises both through holes.

A one piece support housing means that the support housing is a one piece, i.e. made of one piece of material for example by injection molding, casting or milling from one raw material piece.

Housing the gear mechanism typically means encompass most of the volume of the or all components of the gear mechanism.

The gear mechanism typically comprise or consists of the spindle, the nut, a gear wheel, a return spring, a bushing, a second gear wheel on a shaft to transfer motion and/or forces from a third gear wheel to the gear wheel, the third gear wheel on a drive shaft and/or an electrical motor for driving the drive shaft.

In particular, the support housing comprises the bearing for the shaft and drive shaft, preferably plain bearing, preferred implemented through an aperture.

In particular, the support housing is connected to a lower housing, which is preferably secured on a frame plate, wherein the frame plate may be covered by the lower housing and/or a cover plate, in particular in the area of the locking mechanism. In particular, the catch and the pawl are rotatable mounted or pivoted on the frame plate and/or covered by the cover plate.

A one piece support housing for housing the gear mechanism comprises both through holes facilitates to matching narrow tolerances very precisely with reduced effort while reducing the number of parts.

In one embodiment, the spindle is pivoted by means of a hole and another hole, wherein the hole has a bigger diameter than the other hole.

The hole and/or the other hole are in particular a through hole.

Preferably, the hole is a bearing, particular plain bearing, and/or the other hole is another bearing, particular plain bearing. In particular, the bearing has a bigger diameter than the other bearing.

Preferably, the hole or bearing is arranged at one end of the support housing and/or the other hole or bearing is arranged at the other end of the support housing.

Having a hole or bearing being bigger than the other hole or bearing, particularly coaxial holes or bearings, allows the spindle to be assembled through the bigger hole respectively bearing hole in particular at one end of a support housing, through the gear wheel, return spring, bushing, spindle nut, and/or into another hole or bearing hole in particular at the other end of the same particularly one piece support housing.

The advantage is that there is better locational tolerance to mating gears retained in the support housing.

In one embodiment, the hole and the other hole and/or the exactly two through holes are arranged coaxial to each other, in particular coaxial to the spindle axis.

In one embodiment, the clip is connected to the spindle within the hole. Alternatively, the clip can also be connected to the spindle before or after the hole in axial direction. The hole is in particular the hole having the bigger diameter.

The clip being connected to the spindle within the hole means that the clip is connected to the spindle at a section of the spindle which is arranged inside of the hole during operations. In particular, the clip is arranged in the hole.

Preferably, the clip is at least in one direction longer than the diameter of the hole and/or the clip is arranged on a cross plane to the spindle axis.

By having the clip being connected to the spindle within the hole with the bigger diameter allows very high reliability and durability in function of the clip. The clip can thus rest on a larger interface area on the spindle.

In one embodiment, a slit opening is provided that is radially extending into the hole for allowing radially mounting of the clip to the spindle while the spindle is rotatable mounted to the hole and for retaining axial forces of the mounted clip.

Very simple assembly and mounting the clip as well as reliable thrust retention of axial forces of the spindle can thereby be achieved.

Preferably, slit opening refers to a through opening particularly passing or running through the support housing.

In particular, for retaining axial forces of the mounted clip means that the slit opening allows a form-fit connection of the mounted clip and the slit opening or a side wall of the slit opening particularly of the support housing.

Preferably, the slit opening is oriented downwards. This facilitates ease of assembly and mounting the clip.

In particular, the mounted clip is extending into the slit opening. A form-fit connection can thus be achieved.

In one embodiment, the spindle has a T-shape with a head portion with a bigger diameter than a longitudinal body portion.

In particular, the head portion is composed to pivot in the hole with the bigger diameter and/or the end of the body portion is composed to pivot in the other hole with the smaller diameter.

Preferably, the slit opening is slightly larger than the respective outer dimensions of the clip to allow insertion of the clip through the slit opening in a radial direction towards the spindle axis.

By having a T-shaped spindle, simply assembly from one side and high durability in function can be achieved.

In one embodiment, the head portion, the hole, the bearing and/or the support housing comprises a slot for a form-fit connection with the clip, the hole, the bearing, and/or the support housing in axial direction.

Form-fit connection with the clip in axial direction means that the clip can be clipped or mounted in the slot such that a form-fit connection is formed in axial direction. In other words, the clip is blocked from an axial movement by a side wall of the slot.

Preferably, the slot runs at least 180°, preferably 360° about the spindle axis. In particular, the depth of the slot is smaller than the radial expansion of the clip in the slot such that the slot holds the spindle in a tight grip and/or protrudes the circumference of the head portion of the spindle while extending into the hole, the bearing, and/or the support housing.

Preferably, the slot is arranged in a middle area of the head portion in axial direction. In particular, the slot width is slightly larger than the respective outer dimensions of the clip to allow tight seating of the clip in the slot.

Thereby, reliable axial force and/or thrust retention can be achieved.

In one embodiment, gear wheel interface section of the spindle for a torque proof connection to a gear wheel of the gear mechanism. In particular, the gear wheel is used for transferring the motion and/or forces to the spindle.

In particular, the gear wheel interface section is preferably immediately adjacent to the head portion, extending longer in axial direction than the head portion, and/or comprises radial protrusions or hubs, particularly with particular a curved or wave shape in circumferential direction.

Reliable functioning and durability of the gear mechanism can thereby be achieved.

In one embodiment, the vehicle lock comprises a return spring for returning the nut in a parking position, preferably after a nut movement against the return spring force to for example release or unlock the vehicle lock.

Electric power can thus be saved, because the engine or electrical motor is not needed for the back travel or return movement to the parking position.

In one embodiment, the spindle comprises a smooth surface section that particularly serves a guide for the bushing and/or an end stop for the nut, i.e. where the spindle thread ends. In particular, the smooth surface section has a larger expansion in axial direction than the gear wheel and/or has a substantially equal expansion in axial direction like the bushing.

Very high durability of the gear mechanism can be achieved, because the thread of the spindle is not causing damage to the bushing and/or return spring.

In one embodiment, the return spring is preloaded between a bushing and/or the gear wheel in axial direction. Particularly, the return spring is preloaded between the nut and/or the gear wheel in axial direction.

Reliable and effective return of the nut to the park position can be obtained. In particular, the nut pushes the bushing against the return spring force towards the gear wheel, when the gear mechanism is activated for example for releasing the locking mechanism. In particular, the nut will then move in axial direction until the bushing hit the gear wheel and stops the nut. Preferably, after an activation of the gear mechanism for the nut movement, the return spring pushes the bushing in a reverse axial direction towards the parking position until the bushing hits the parking stop. During this movement, the bushing pushes the nut forward in the same direction. Due to the thread friction, the nut immediately stops when the bushing stops its movements.

In one embodiment, a parking stop defines the parking position of the nut, particularly by the support housing, preferably by an edge of the support housing. In particular, the bushing is pressed against the parking stop in parking position of the nut and thus prevents further movement of the nut away from the gear wheel.

A repeatable movement to the stop position is thereby achieved.

In particular, the bushing has a longitudinal cylindrical shaped portion with a radial extending circumferential collar at the end of the cylindrical shaped portion to receive the return spring, wherein the cylindrical shaped portion serves to guide the return spring between the collar and the gear wheel.

Preferably, the gear wheel has a U-shaped receiving portion to receive the return spring.

In one embodiment, the support housing has a guiding section to guide the nut during a translational movement in axial direction while preventing rotation of the nut about the spindle axis.

A high efficiency in transforming the rotational motion of the spindle into translational motion of the nut can thus be achieved.

In one embodiment, the vehicle lock comprises a release lever for moving the pawl to unlatching the pawl from the catch. Preferably, the release lever is coupled with the nut such that the release lever is moved by the nut in either axial direction during translational nut movement.

Highly effective automated unlocking and a robust functionality can thereby be achieved.

In one embodiment, the clip is a wire clip.

Wire clip means a clip made of a wire, preferably metal wire. In particular, a wire clip is made of only one piece of wire.

A low cost but highly reliable and easy to assembly clip can be thereby provided.

Preferably, the clip has a narrowing.

Preferably, the clip has a rectangular and/or U-shape, particularly with a bottle neck shaped opening area at the open side. In particular, the width of the U-shape equals at the top and the bottom. Preferably, the length of the U-shape is higher than the width. The width is measured between the both substantially I-shaped side arms or the length of the bottom connecting both side arms. The length corresponds to the length of the side arms. Preferably, both side arms have the same length.

In one embodiment, the clip is an E-clip.

With an E-clip, friction can be reduced.

The features of each embodiment as well as features of the above description and the features of the figure description can be combined with each other and combined with the subject matter of the invention, the below described other aspect of the invention concerning an assembly method and the subject matter of each claim.

All combinations of one or more embodiments and/or aspects of the invention with one or more claims is hereby disclosed.

BRIEF DESCRIPTION OF THE DRAWINGS

Details and further advantages are provided in the following description of the figures which depicts a preferred execution example with the necessary details and individual components.

DETAILED DESCRIPTION

Figure 3:
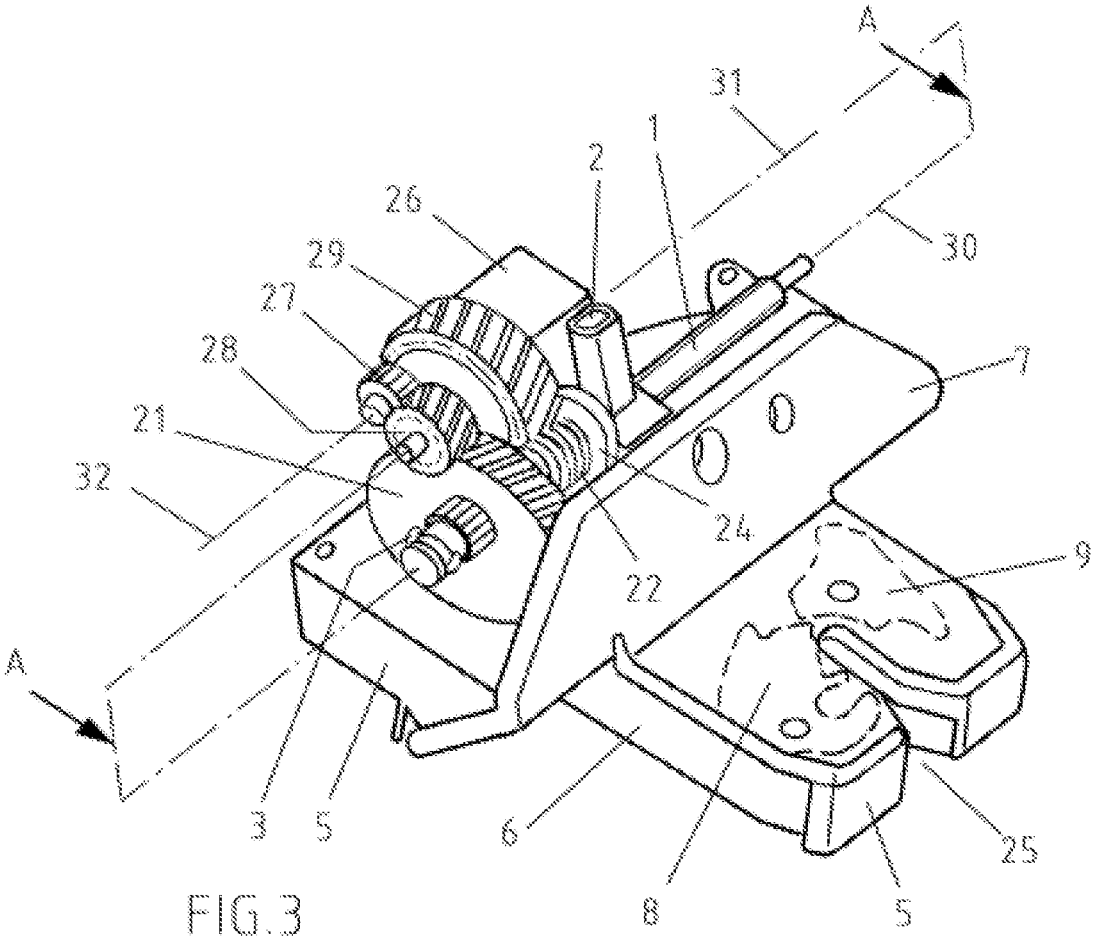
FIG. 3: Isometric view without support housing of the exemplary embodiment of the vehicle lock having the clip realized as an E-clip
Figure 4:
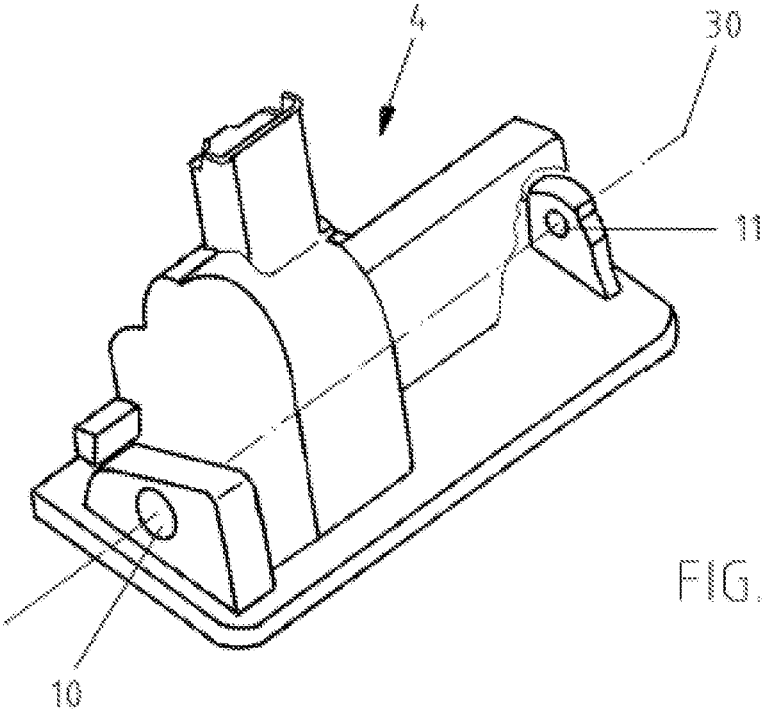
FIG. 4: Support housing of the vehicle lock of FIG. 3 with a partial section to show the other hole for pivoting the end of the spindle.

The shown vehicle lock for a door or flap comprise a catch 8 and a pawl 9 being rotatable mounted on the frame plate 6 made of metal and covered by the cover plate 7 (see FIG. 3). A lower housing 5 may extend from below the support housing 4 for the gear mechanism to the area of the locking mechanism between the frame plate 6 and the cover plate 7.

When the door is closed, the locking bolt (not shown) of the door is entering the vehicle lock though the entry slot 25 and is received by the catch 8 being in a opening position. The locking bolt then turns the catch 8 against the force or torque of a catch spring (not shown) until the catch 8 reaches the latching position, where the pawl 9 turns to latch the catch 8 in said latching position.

Preferably, there is also provided an ancillary latching position of the catch 8 and the pawl 9 such that if the catch 8 has passed said ancillary latching position in the course of closing the door, but failed to reach the latching position for some reasons, the door is still blocked from opening by means of the ancillary latching position, which prevent the catch 8 to return to its opening position, once the catch 8 has passed the ancillary latching position.

A release lever 23 serves to move the pawl 9 to release the catch 8 from the latching position and/or ancillary latching position.

Figure 1:
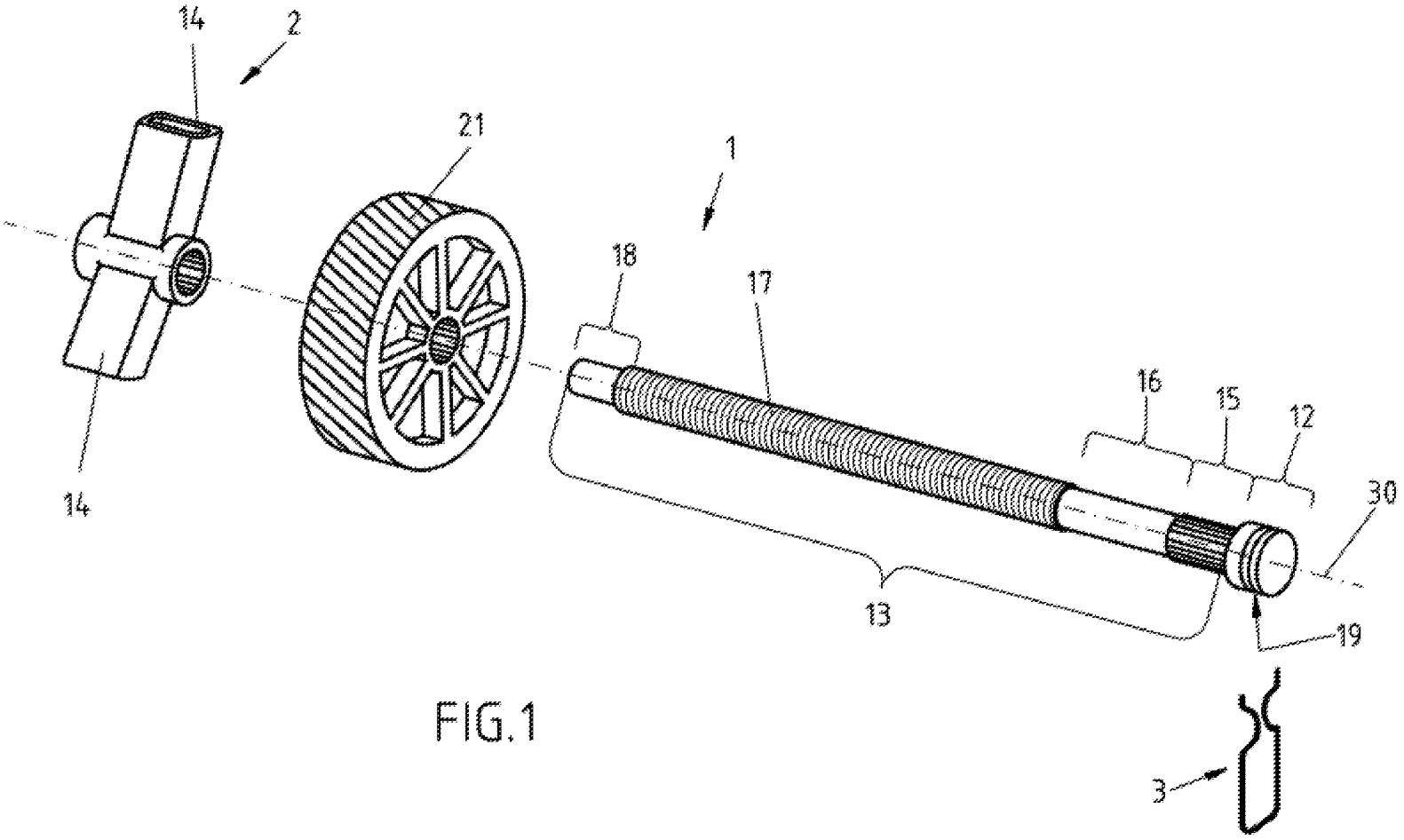
FIG. 1: Explosion view of the nut, the gear wheel, the spindle and the clip realized as a wire clip
Figure 2:
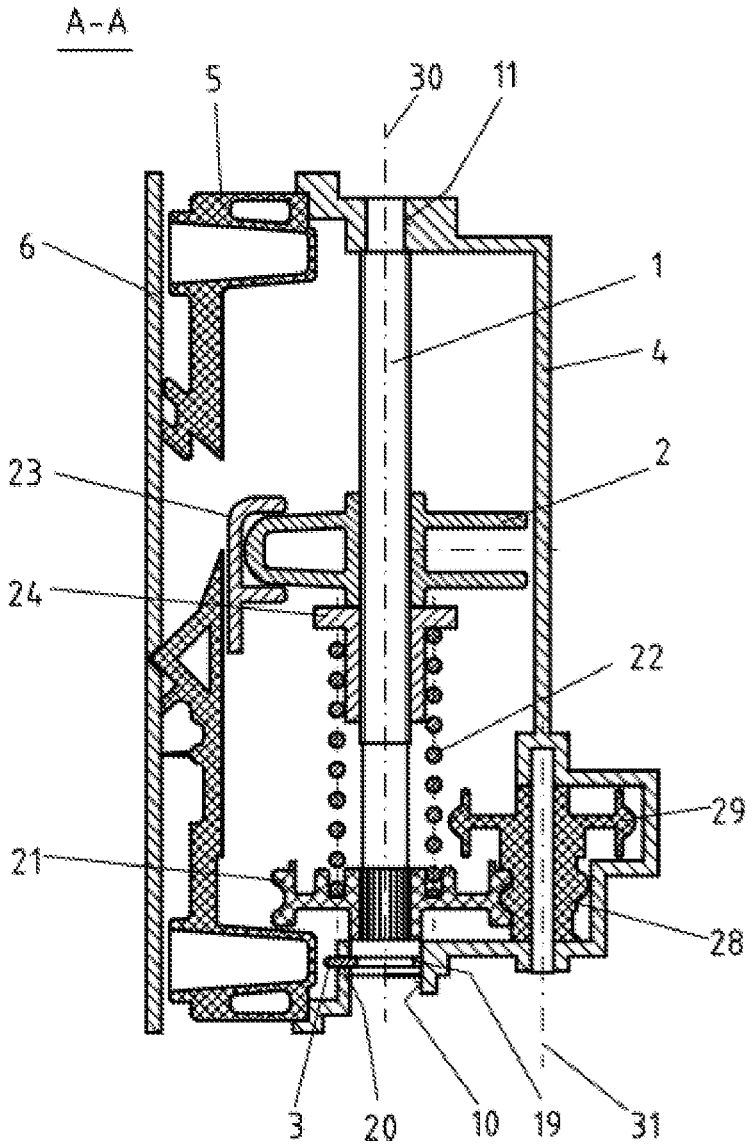
FIG. 2: Top-down cross section view an exemplary embodiment of the vehicle lock having the clip realized as an E-clip

In one embodiment, as shown in FIG. 2, said release lever 23 is coupled or connected to the nut 2 of the gear mechanism such that the gear mechanism can be activated to unlock the lock.

In particular, the gear mechanism comprise an electrical motor 26, which upon activation generates and induces a drive force and motion on a drive shaft having a drive shaft axis 32 and a third gear wheel 27 mounted on the drive shaft.

The third gear wheel 27 transfers the force and motion to a second gear wheel 29 though an intermediate gear wheel 28 being mounted on the same shaft like the second gear wheel 29 having the shaft axis 31 (see FIG. 3).

The cross section view of FIG. 2 runs though the shaft axis 31 and the spindle axis 30 of the spindle 1.

The spindle 1 has a T-shape with a head portion 12 and a longitudinal body portion 13. Preferably, the diameter of the head portion 12 is at least 15% and/or at most 50% larger than the diameter of the body portion 13.

The head portion 12 has a smooth surface and particularly in a middle area a surrounding slot 19 for receiving the clip 3. Immediately adjacent to the head portion is arranged a gear wheel interface section 15 with star-like circumference shape having protrusions extending linear in axial direction for connecting to the gear wheel 21 in a torque proof manner.

Immediately adjacent to the gear wheel interface section 15 is arranged a smooth surface section 16.

Immediately adjacent to the smooth surface section 16 is arranged a thread section 17, which is the longest of all other sections in axial direction of the spindle 1.

The smooth surface section 16 preferably has a diameter that corresponds to the outer diameter of the spindle thread of the thread section 17 to enable a stop function for the nut 2.

Immediately adjacent to the thread section 17 is arranged the end of the spindle 18, preferably also having a smooth surface and cylindrical shape to be pivoted in the other hole 11.

One separate aspect of the invention concerns a method for assembly a vehicle lock for a door or a flap of a motor vehicle, the vehicle lock comprises a locking mechanism with a catch 8 and a pawl 9 for latching the catch 8 as well as a gear mechanism with a spindle 1 for moving a nut 2 and for transferring a motion and/or force to the locking mechanism by the nut movement for locking or unlocking the vehicle lock, wherein the vehicle lock comprises a clip 3 that is composed to hold the spindle 1 in an axial position, the method comprises the steps, preferably in the exact following order, of:

the spindle 1 is inserted from one end of a support housing 4 for housing the gear mechanism though a hole 10 of the support housing 4, preferably as plain bearing, with a bigger diameter than a coaxially arranged other hole 11, preferably as plain bearing, at another end of the particularly same and/or one piece support housing 4;

after the spindle 1 has passed through the hole 10, preferably first with an end section 18 of the spindle 1, the spindle 1 is further inserted though a gear wheel 21, a return spring 22, a bushing 24 for mounting the return spring 22 between the bushing 24 and the gear wheel 21, the nut 2, and into the coaxial other hole 11 at the other end of the support housing 4;

the clip 3 is mounted to the spindle, preferably though a slit opening 20, preferably from the bottom side radially towards the spindle axis 30, such that the clip 3 forms a form fit connection with the spindle 1, preferably by means of a slot 19, and also with the support housing 4, preferably by means of the slit opening 20.

Very simple assembly in short time can be achieved.

The bushing 24 is preferably limited in its axial motion away from the gear wheel 21 by a parking stop (not shown) formed by the support housing 4. Preferably, the return spring 22 is always under tension in assembled condition.

When the bushing 24 is pressed against the parking stop, the nut 2, which is arranged adjacent to the bushing 24, and/or the bushing 24 are in a parking position.

When the car driver or user press a button to unlock the vehicle lock for the door or flap, the electrical motor 26 is activated and generates the force and motion, which is transferred by the gear wheel 21 to the spindle 1 and results in a rotation of the spindle 1. Because the nut 2 is guided in the support housing 4 such that the nut 2 can axially translate but not rotate about the spindle axis 30, the rotation of the spindle leads to the nut 2 movement.

The nut 2 has an internal thread that is mating the external thread of the spindle 1. The nut 2 has one or two radially extending arms 14, preferably in the shape of a hollow and/or longitudinal profile, preferably with a closed outer wall seen in a cross sectional view e.g like a O-shape.

The nut movement is directed towards the gear wheel 21, thus against the return spring force. The nut 2 pushes the bushing 24 towards the gear wheel 24 until the end of the electrical motor activation, until the bushing 24 hit against the gear wheel 21 and/or until the nut 2 reaches the end of the threaded section 17 and/or the smooth surface section 16.

The nut 2 thereby moves the release lever 23 in a direction to unlatch the pawl 9 from the catch 8 such that the door or flap can be opened.

Once the electrical motor 26 is deactivated, the return spring pushes the bushing 24 and the busing 24 the nut 2 back to the parking position. The return spring is typically dimensioned to overcome the counteracting friction forces such that the return movement does not need electrical power.

In particular, by driving the spindle 1 though the gear mechanism, also cinching the catch 8 is enabled, which is not described in further detail herein.

The clip 3 retains, i.e. absorbs, the axial forces of the spindle 1 during operations.

The axial forces are transferred to the clip 3 by means of the slot 19 of the spindle 1, where the clip 3 is mounted to. In particular, the clip hatches the spindle 1 at the circumference at the bottom of the slot 19. On the other hand, the clip 3 protrudes the slot 19 and is extending into the slit opening 20 of the support housing 4. By this way, the axial forces of the spindle 1 are absorbed by the clip 3, which hold the spindle 1 in its axial position by leaning against the support housing 4.

Multiple variations and modifications are possible in the embodiments and between the aspects of the invention and the embodiments of the invention described herein and thereby covered by the scope of the invention. In some instances, some features of the present invention may be employed without a corresponding use of the other features. Accordingly, it is appropriate that the foregoing description be constructed broadly and understood as being given by way of illustration and example only.

What is claimed is:

1. A vehicle lock for a door or a flap of a motor vehicle, the vehicle lock comprising:

a locking mechanism with a catch and a pawl for latching the catch, a gear mechanism with a spindle for moving a nut, the gear mechanism being arranged to transfer a motion and/or force to the locking mechanism by movement of the nut for locking or unlocking the vehicle lock, wherein the pawl latches the catch during the locking of the vehicle lock, a housing, and a clip that is configured to absorb axial forces acting on the spindle during movement of the nut, thereby holding the spindle in an axial position relative to the housing, wherein at least part of the clip is elastically deformable to define an entrance opening for the spindle, the entrance opening being configured to elastically widen to temporarily increase the entrance opening and enable insertion of at least a portion of the spindle through the entrance opening so as to be received in the clip, the entrance opening being configured to elastically contract to an original shape of the clip after the at least a portion of the spindle has passed through the entrance opening thereby radially mounting the clip to the spindle, wherein the housing has a slit opening that is configured to enable the radially mounting of the clip to the spindle, wherein the slit opening is a through opening that passes through the housing, wherein the slit opening and the clip are configured to have a form-fit connection such that the spindle is held in the axial position relative to the housing when the clip is radially mounted to the spindle, and wherein the clip is a wire clip formed of a wire.

2. The vehicle lock of claim 1, wherein the clip is the only clip provided for absorbing axial forces acting on the spindle.

3. The vehicle lock of claim 1, wherein the spindle is allowed to pivot by exactly two through holes formed in the housing.

4. The vehicle lock of claim 3, wherein the housing is formed as a one piece support housing for housing the gear mechanism, wherein the one piece support housing includes both of the two through holes.

5. The vehicle lock of claim 3, wherein the two through holes form plain bearings.

6. The vehicle lock of claim 1, wherein the spindle is allowed to pivot by a hole and another hole of the housing, wherein the hole has a bigger diameter than the other hole.

7. The vehicle lock of claim 6, wherein the slit opening radially extends into the hole to allow radially mounting of the clip to the spindle while the spindle is pivotally mounted to the hole, such that the clip is mounted to absorb the axial forces acting on the spindle.

8. The vehicle lock of claim 7, wherein the spindle includes a circumferential slot formed therein that receives a first portion of the clip, and wherein a second portion of the clip protrudes from the slot into the slit opening, thereby holding the spindle in the axial position relative to the housing.

9. The vehicle lock of claim 1, wherein the spindle has a T-shape with a head portion with a bigger diameter than a longitudinal body portion.

10. The vehicle lock of claim 1, wherein a head portion of the spindle comprises a slot for a form-fit connection with the clip in an axial direction.

11. The vehicle lock of claim 1, including a gear wheel interface section of the spindle for a torque proof connection to a gear wheel of the gear mechanism.

12. The vehicle lock of claim 1, including a return spring for returning the nut to a parking position.

13. The vehicle lock of claim 12, wherein the return spring is preloaded between a bushing and a gear wheel of the gear mechanism in an axial direction.

14. The vehicle lock of claim 1, including a release lever for moving the pawl to unlatch the pawl from the catch.

15. The vehicle lock of claim 1, wherein the clip is an E-clip.

16. A vehicle lock for a door or a flap of a motor vehicle, the vehicle lock comprising:

a locking mechanism with a catch and a pawl for latching the catch, a gear mechanism with a spindle for moving a nut, the gear mechanism being arranged to transfer a motion and/or force to the locking mechanism by movement of the nut for locking or unlocking the vehicle lock, wherein the pawl latches the catch during the locking of the vehicle lock, a housing, and a clip that is configured to absorb axial forces acting on the spindle during movement of the nut, thereby holding the spindle in an axial position relative to the housing, wherein the clip is a wire clip formed of a wire and at least part of the clip is elastically deformable, wherein the housing has a slit opening that is configured to enable radially mounting of the clip to the spindle, wherein the slit opening is a through opening that passes through the housing, and wherein the slit opening and the clip are configured to have a form-fit connection such that the spindle is held in the axial position relative to the housing when the clip is radially mounted to the spindle.

17. The vehicle lock according to claim 16, wherein the wire clip wraps around at least most of a circumference of the spindle.

* * * * *